United States Patent [19]

Li et al.

[11] 4,135,280

[45] * Jan. 23, 1979

[54] METHOD AND APPARATUS FOR TEXTURIZING CONTINUOUS FILAMENTS

[75] Inventors: Hsin L. Li, Parsippany; Hendrikus J. Oswald, Morristown; Alfred L. Liland, Lake Shawnee, all of N.J.

[73] Assignee: Allied Chemical Corporation, Morris Township, Morris County, N.J.

[ * ] Notice: The portion of the term of this patent subsequent to May 24, 1994, has been disclaimed.

[21] Appl. No.: 799,628

[22] Filed: May 23, 1977

Related U.S. Application Data

[63] Continuation-in-part of Ser. No. 619,085, Oct. 2, 1975, Pat. No. 4,024,611.

[51] Int. Cl.[2] ..... D02G 1/20; D02G 1/16; D02G 1/12

[52] U.S. Cl. ..... 28/257; 28/265

[58] Field of Search ..... 28/254, 256, 257, 260, 28/267, 265

[56] References Cited

U.S. PATENT DOCUMENTS

| | | | |
|---|---|---|---|
| 2,734,228 | 2/1956 | Hay | 28/267 |
| 3,156,028 | 11/1964 | Weiss et al. | 28/257 |
| 3,438,101 | 4/1969 | Le Noir et al. | 28/256 |
| 3,859,697 | 1/1975 | Guenther | 28/254 |
| 3,861,133 | 1/1975 | Frankfort et al. | 28/260 |
| 3,899,811 | 8/1975 | Bauch | 28/257 |
| 4,024,610 | 5/1977 | Li et al. | 28/257 |

FOREIGN PATENT DOCUMENTS

| | | | |
|---|---|---|---|
| 1198035 | 7/1970 | United Kingdom | 28/257 |

*Primary Examiner*—Louis Rimrodt

*Attorney, Agent, or Firm*—Robert A. Harman; Ernest D. Buff

[57] ABSTRACT

Continuous filaments are fed by aspiration into a stream of heated fluid in a conduit. The filaments are then contacted with at least a second stream of heated fluid in a second conduit of increased cross-sectional area to increase the temperature of the filaments. The combined streams of fluid containing the filaments are transferred to an energy tube having an angular disposition relative to a barrier disposed within a chamber and are directed by said energy tube into contact with said barrier at a force sufficient to initiate crimping of the filaments. A major portion of the fluid is separated from the filaments and expelled from the chamber. The filaments are transported through the chamber by continuous movement of a surface therein at sufficient velocity to cause overfeeding of the filaments, whereby the filaments are forced against a mass thereof and emerge from the chamber in crimped form.

22 Claims, 7 Drawing Figures

FIG. 4
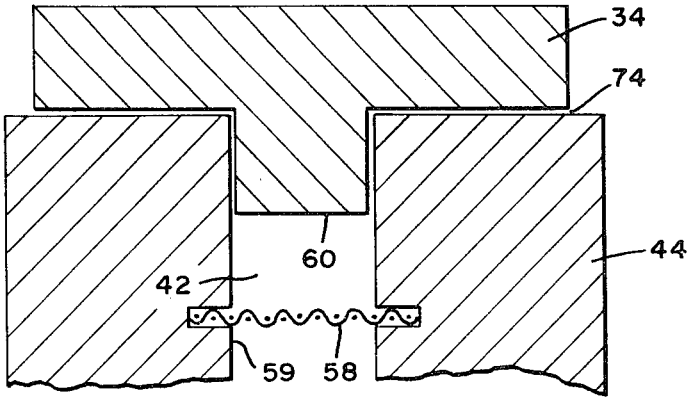
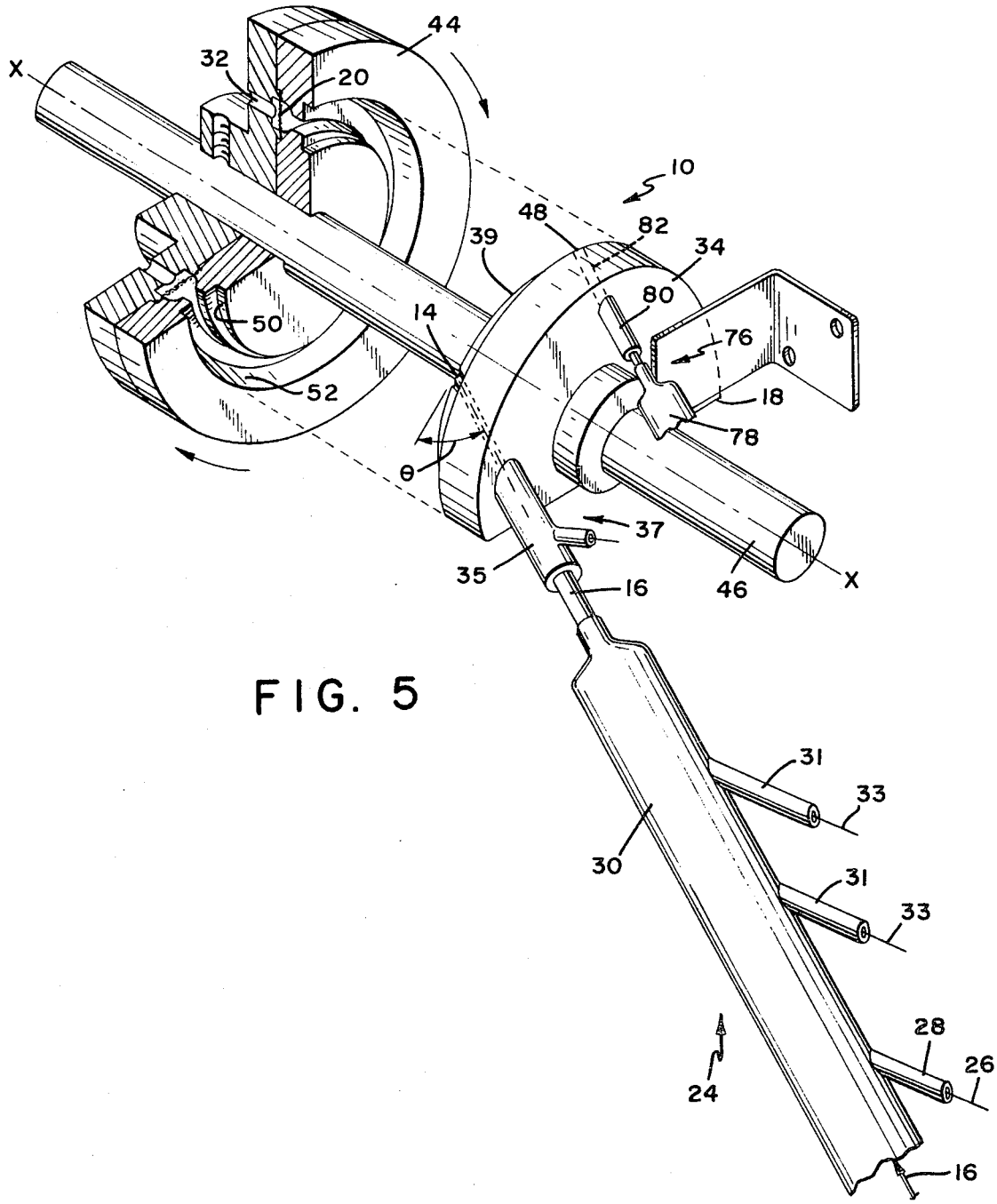
FIG. 5

METHOD AND APPARATUS FOR TEXTURIZING CONTINUOUS FILAMENTS

CROSS-REFERENCE TO RELATED APPLICATIONS

This application is a continuation-in-part of copending application Ser. No. 619,085, filed Oct. 2, 1975, entitled "Method and Apparatus for Texturizing Continuous Filaments," now U.S. Pat. No. 4,024,611 of May 24, 1977.

BACKGROUND OF THE INVENTION

1. Field of the Invention

This invention relates to method and apparatus for preparing crimped fibrous structures and more particularly to means for crimping textile fibrous materials such as filaments, yarn, tow for staple fibers and the like.

2. Description of the Prior Art

In the apparatus conventionally used to crimp textile strands to increase their bulkiness, a tow of continuous filaments is forced by fluid energy against a mass of tow within a chamber, and emerges in crimped form from the chamber when the pressure on the mass exceeds a certain limit. The number of crimps produced by such apparatus per inch of the filaments, as well as the skein shrinkage or crimp contraction level produced in the filaments, is too low for economical processing of the filaments into high quality knitting yarns, fabrics, high stretch yarns and the like. Higher fluid temperatures, as in the order of 400° C., increase crimping levels but decrease orientation of the filaments, reducing their tensile strength and/or dyeing uniformity. Increasing mass flow of the fluid to heat the yarn at lower fluid temperatures produces turbulence within the chamber, destroying incipient crimp and decreasing the skein shrinkage level of the filaments.

SUMMARY OF THE INVENTION

The present invention provides a method and apparatus whereby continuous filaments are crimped at relatively low temperature in an economical and highly reliable manner. The filaments, which may be in the form of yarn, are fed by aspiration into a stream of heated fluid in a conduit, the temperature of the fluid being, for example about 150° to 350° C. The filaments are then contacted in a second conduit of increased cross-sectional area with at least a second stream of heated fluid having a temperature of about 180° to 280° C. to increase the temperature of the filaments and minimize the temperature gradient thereof. The combined streams of fluid and filaments are transferred to an energy tube having an angular disposition relative to barrier means disposed within a chamber and are directed by said energy tube into contact with said barrier, the force of contact being sufficient to initiate crimping of the filaments. Upon contact with the barrier means, the major portion of the compressible fluid is separated from the filaments and expelled from the chamber. The filaments are transported through the chamber by continuous movement of a surface therein at sufficient velocity to cause overfeeding of the filaments into the chamber. Due to such overfeeding, the filaments are forced against a mass of the filaments within a zone of compaction in the chamber, producing crimps therein. The chamber has an inlet opening for receiving the filaments, an outlet opening for withdrawing the filaments therefrom and fluid escape means for separating the fluid from the filaments and expelling it from the chamber. A carrier means associated with the chamber and adapted for movement with respect thereto forms the continuously moving surface.

It has been found that heating filaments in a conduit and then contacting the filaments in a second conduit of increased cross-sectional area with at least a second stream of fluid to raise the temperature of the center and exterior surface of each of the filaments in a uniform manner increases the number of crimps per inch of the filaments as well as the memory thereof. Further, the flexibility of the filaments is also increased and crimp sharpness is improved. Due to the increased flexibility and crimp sharpness created in the filaments during crimping, the pressure and temperature of the fluids required for crimping are surprisingly low, i.e. about 10 to 500 psig and about 150° to 350° C. with the result that the crimps are produced in a highly efficient manner. Crimping levels are unusually high, i.e. in excess of 40 crimps per inch and typically as high as 60 crimps per inch or more. Filament degradation, fusion and breakage are minimized. Skein shrinkage level is greatly improved, i.e. in excess of 40%, and uniformity and consistency of crimp are easily controlled. Thus, the invention permits production of high bulk and/or stretch knitting yarns at higher speeds and lower temperatures and costs than those incurred by conventional operations wherein the filaments are crimped using a single heating stage.

BRIEF DESCRIPTION OF THE DRAWINGS

The invention will be more fully understood and further advantages will become apparent when reference is made to the following detailed description and the accompanying drawings in which:

FIG. 4 is a cross-section taken along the line 4—4 of FIG. 3;

FIG. 5 is a perspective view illustrating an alternate embodiment of the apparatus shown in FIG. 1;

DESCRIPTION OF THE PREFERRED EMBODIMENT

The crimping apparatus of this invention comprises a chamber having inlet, outlet, heating and fluid escape means. Such chamber may be fabricated in a number of diverse sizes and configurations. For illustrative purposes the invention is described in connection with a chamber having an arcuate configuration. It will be readily appreciated, however, that chambers having linear as well as curvilinear configurations fall within the scope of the present invention.

Figure 1:
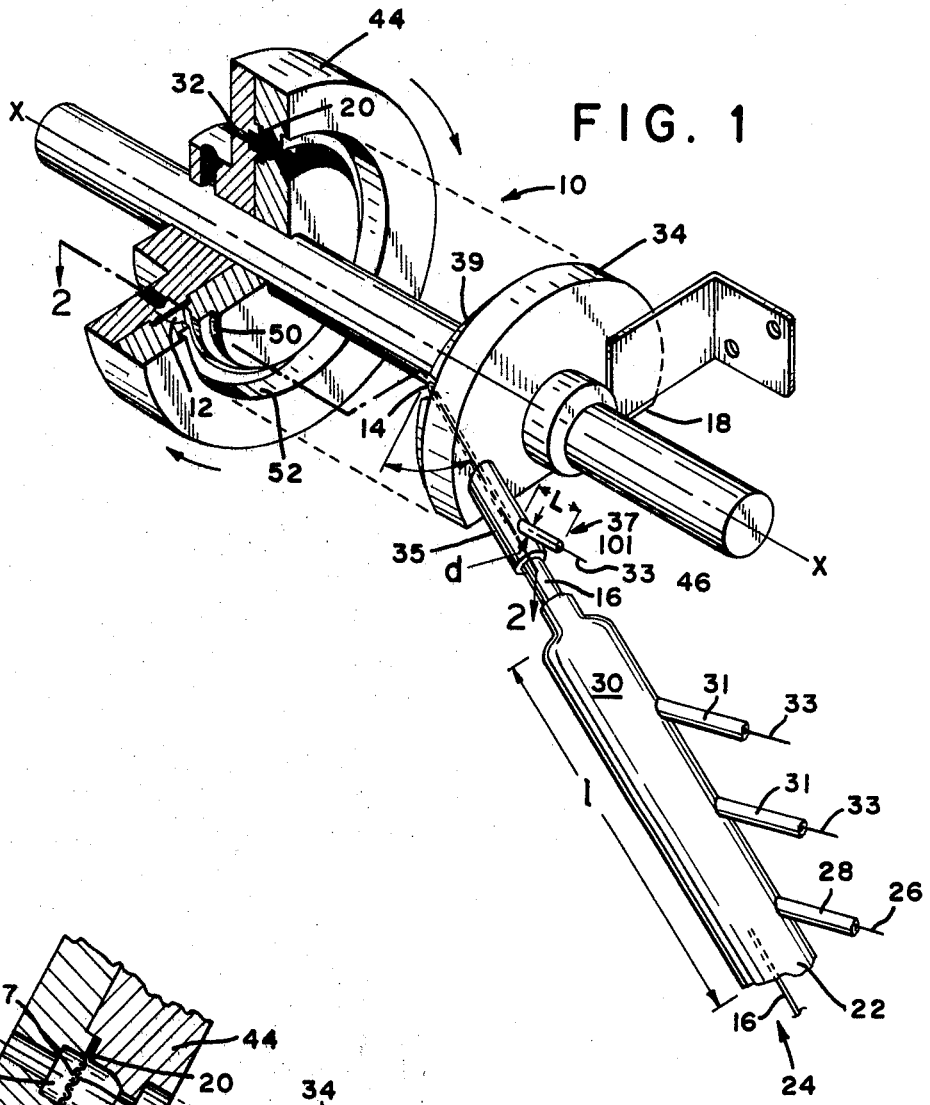
FIG. 1 is a perspective view illustrating one form of apparatus for carrying out the method of this invention, the cover and chamber of the apparatus having a disengaged position and the chamber being partially broken away to show the construction thereof.
Figure 2:
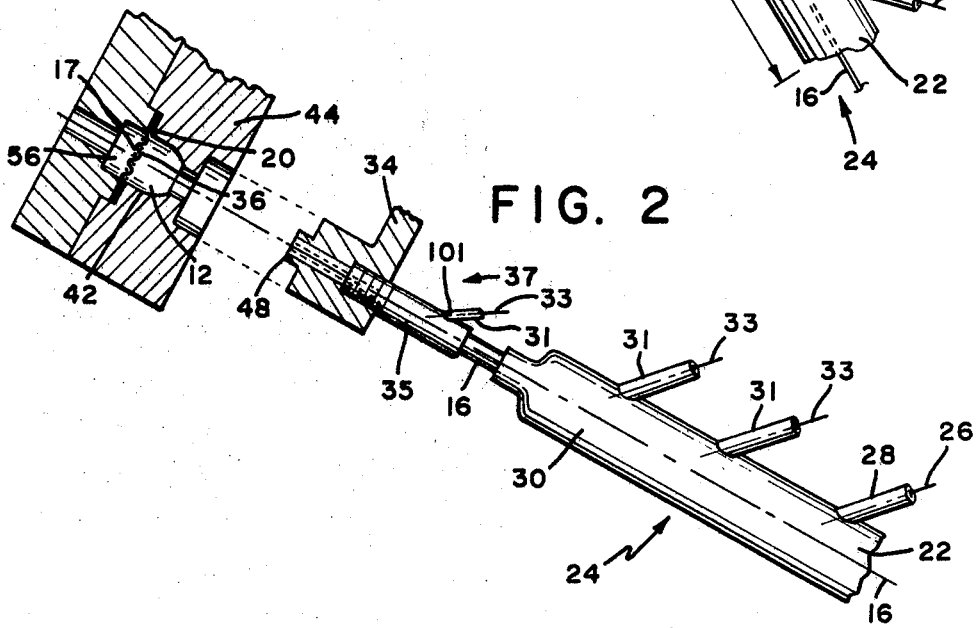
FIG. 2 is a section taken along the line 2—2 of FIG. 1, the cover and chamber of the apparatus having a disengaged position.

Referring to FIGS. 1 and 2 of the drawings, the crimping apparatus shown generally at 10 has a chamber 12 including an inlet opening 14 for receiving the filaments 16 to be crimped and a barrier means 20 which represents a portion of a perforated plate 17, as shown in FIG. 2 and described hereinafter, is disposed within the chamber 12 adjacent inlet opening 14. Continuous filaments 16, preferably in the form of yarn having a temperature of about 15° to 32° C. enter inlet 22 of a heating means, shown generally at 24. Steam or some other heated fluid, such as heated air, nitrogen, carbon dioxide and the like, having a temperature of about 150° to 350° C., preferably about 200° to 330° C., enters fluid inlet 28 and forces filaments 16 along a conduit within tube 30 of heating means 24. Tube 30 is provided with a second fluid inlet 31 and preferably a plurality of additional fluid inlets for directing at least a second stream of heated fluid, having a temperature of about 150° to 350° C., preferably about 200° to 330° C., into contact with filaments 16 in a second, larger conduit within tube 30 and, optionally, in tube 35 of fluid directing means, shown generally at 37, to increase the temperature of the filaments and minimize the temperature gradient thereof. After contact with streams of fluid 26 and 33, filaments 16 from tube 30 are aspirated into energy tube 35 of fluid directing means by stream 33 of nozzle 101 and are directed thereby into contact with barrier means 20, the contact having sufficient force to initiate crimping of the filaments 16. Upon contact with barrier means 20, the major portion of the fluid passes through fluid escape means 32 and is thereby separated from the filaments 16 and expelled from the chamber 12. In order to prevent removal of crimp or deformation initiated in the filaments 16 during separation of the fluid therefrom, it is necessary to prevent the filaments from being subjected to tension or drag during the period of their residence in chamber 12. The initially crimped filaments 16 containing incipient crimps are therefore transported through the chamber 12 by a carrier means which comprises a surface 36 formed by screen 17 adapted for movement relative to the chamber 12 at a velocity sufficient to cause overfeeding of the filaments thereinto. Due to such overfeeding, the filaments 16 are forced against a mass 38 of the filaments 16 within a zone of compaction 40 (shown in FIG. 3) in the chamber 12 producing crimps therein. The crimped filaments emerge through outlet opening 18 of the chamber 12 in final crimped form.

Chamber 12 is defined by peripheral recess 42 (shown in FIG. 2) in drum 44 and opposing wall 39 of cover 34. The drum 44 is mounted on shaft 46 for rotation about axis x—x. Fluid from nozzle 101 and filaments 16, is directed through tube 35 into contact with barrier means 20 disposed in chamber 12. Thereafter the fluid is separated from the filaments 16 and expelled from chamber 12 through passageways 56 formed in drum 44. Drum 44 is provided with discharge ports (not shown) extending through the drum and connecting with an annular chamber 56 under recess 42. The annular chamber 56 is separated from the recess 42 by perforated plate or screen 17, which forms the bottom of recess 42 and, together with chamber 56 and the discharge ports, comprises the fluid escape means 32. Screen 17 has a mesh size ranging from about 50 to 400, and preferably from about 100 to 325.

The barrier means 20 comprises a portion of perforated plate 17 adapted to intercept the compressible fluid stream from fluid directing means 37. In the apparatus shown in FIG. 1 of the drawing, the portion of screen 17 which represents barrier means 20 changes continuously as the periphery of drum 44 rotates. Alternatively, the barrier means can comprise a porous or nonporous plate (not shown) fixedly mounted on the fluid directing means 37 and projecting to a point of interception with streams 26, 33 inside chamber 12 and adjacent to the inlet opening 14 thereof.

Fluid directing means 37 is positioned relative to drum 44 so that the end 48 of tube 35 is in relatively close proximity to barrier means 20. The distance between end 48 and barrier means 20, as well as the cross-sectional area of the end 48 can be varied depending on the velocity and temperature of the filaments and of the fluid stream, the denier of the filaments, the angle at which the stream intersects the barrier means 20, the coefficient of friction of the impacting surface of barrier means 20 and the cross-sectional area of chamber 12. Generally, upon impact with the barrier means 20, fluid stream 33 has a velocity of about 300 to 1500 feet per second and a temperature of about 100° to 280° C. and a total pressure of about 10 to 50 psig; and filaments 16 have a velocity of about 200 to 30,000 feet per minute, a temperature of about 100° to 250° C., a denier of about 1 to 25 per filament, and a yarn denier of about 15 to 5,000. The coefficient of friction of the impacting surface is about 0.05 to 0.9, the angle of impact, $\theta$, is about 15° to 75° C. The distance between end 48 and point of impact of fluid stream 33 on surface 36 is about 0.01 to 0.5 inch, the cross-sectional area of end 48 is about 0.0002 to 0.75 square inch and the cross-sectional area of chamber 12 is about 0.00015 to 1.00 square inch.

Preferably, fluid stream 33 contacts the impacting surface of barrier means 20 at a velocity of about 600 to 1500 feet per second, a total pressure of about 20 to 300 psig and a temperature of 180° to 280° C., causing filaments having a denier of about 2 to 15 per filament and a yarn denier of about 21 to 2,600 to contact the impacting surface at a velocity of about 3,000 to 23,000 feet per minute and temperature of about 150° to 220° C. The coefficient of friction of the impacting surface is preferably about 0.1 to 0.6, the angle of impact, $\theta$, is preferably about 30° to 70°, the distance between end 48 and point of impact of fluid stream 33 on surface 36 is preferably about 0.02 inch to 0.30 inch, the cross-sectional area of end 48 is about 0.0006 to 0.40 square inch and the cross-sectional area of chamber 12 is about 0.00075 to 0.70 square inch.

Fluid escape means 32 is located with respect to barrier means 20 so that a major portion of fluid stream 33 contacting barrier means 20 is separated from filaments 16 and expelled from chamber 12. The fluid escape means 32 comprises perforated plate or screen 17, together with exhaust chamber 56 and discharge ports leading to a point exterior of drum 44. The number and diameters of the apertures are sufficient to separate from filaments 16 and expel from chamber 12 a major portion of fluid stream 33 contacting barrier means 20 as in the order of about 60 to 98 percent, and preferably about 70 to 95 percent thereof. The fluid escape means can also comprise a plurality of apertures provided in cover 34.

Referring again to FIGS. 1 and 2, filaments 16 entering compaction zone 40 impinge against previously advanced filaments (mass 38 of filaments 16) which has not been withdrawn due to the greater feed rate of filaments 16 into zone 40 in comparison to the rate at which the mass 38 is removed from the zone. As a result of this overfeed further crimp is imparted to the filaments 16.

After impinging against the mass 38 of filaments 16, the crimped filaments move in recess 42 for about ¼ to ¾ of a rotation of drum 44 to outlet opening 18 where they are taken up on conventional bobbins using conventional winders and the like. Rear extension blocks 54 connected to tube 70 by rivets (not shown), adhesive or the like, prevents filaments 16 or plugs thereof, which are inadvertently broken during residence in chamber 12 from reentering the chamber 12.

In the embodiment shown in FIGS. 1 and 2, the carrier means for transporting filaments 16 through chamber 12 is a surface including walls 50, 52 and perforated plate 17 of recess 42. The carrier means can alternatively be comprised of perforated plate 17 solely. Carrier velocity varies inversely with the surface area thereof and the crimp frequency desired. Generally the velocity of the carrier means shown in FIGS. 1 and 2 is about 0.1 to 10 percent of the velocity of filaments 16. By varying the velocity of the carrier means, the residence time of filaments 16 in compaction zone 40 is controlled to produce uniformity of crimp and degree of set in the filaments 16 over a wide range of crimp level.

The apparatus 10 which has been disclosed herein can be modified in numerous ways without departing from the scope of the invention. As previously noted, the configuration of chamber 12 can be linear or curvilinear. Barrier means 20 can be porous or nonporous and can comprise a stationary noncontinuous or movable continuous impacting surface. Each of peripheral recess 42 of drum 44 and cover 34 can be perforated to provide for escape of compressible fluid through all sides of chamber 12. The length, 1, of tube 30 can be varied to alter the residence time of filaments 16 therein. Generally, the heating means 24 includes a tube 30 having a length of about 3 to 60 inches; fluid inlets 28, 31 are spaced longitudinally of tube 30 by a center to center distance of about 1 to 10 inches; the cross-sectional areas of the fluid inlets 28, 31 are about 0.00008 to 0.03 square inch; and the number of fluid inlets 28, 31 is about 1 to 60. Preferably, tube 30 of heating means 24 has a length, 1, of about 6 to 42 inches; fluid inlets 28, 31 are spaced longitudinally of tube 30 by a center to center distance of about 2 to 5 inches; the cross-sectional areas of the fluid inlets 28, 31 are about 0.0003 to 0.020 square inch; the number of fluid inlets 28, 31 are about 2 to 10. The fluid of which streams 26, 33 are comprised can be either compressible or incompressible. Compressible fluids which are suitable include air, steam, nitrogen, argon, gas mixtures and the like. Incompressible fluids which are suitable include water, saturated steam, mixtures of liquids and the like.

Figure 3:
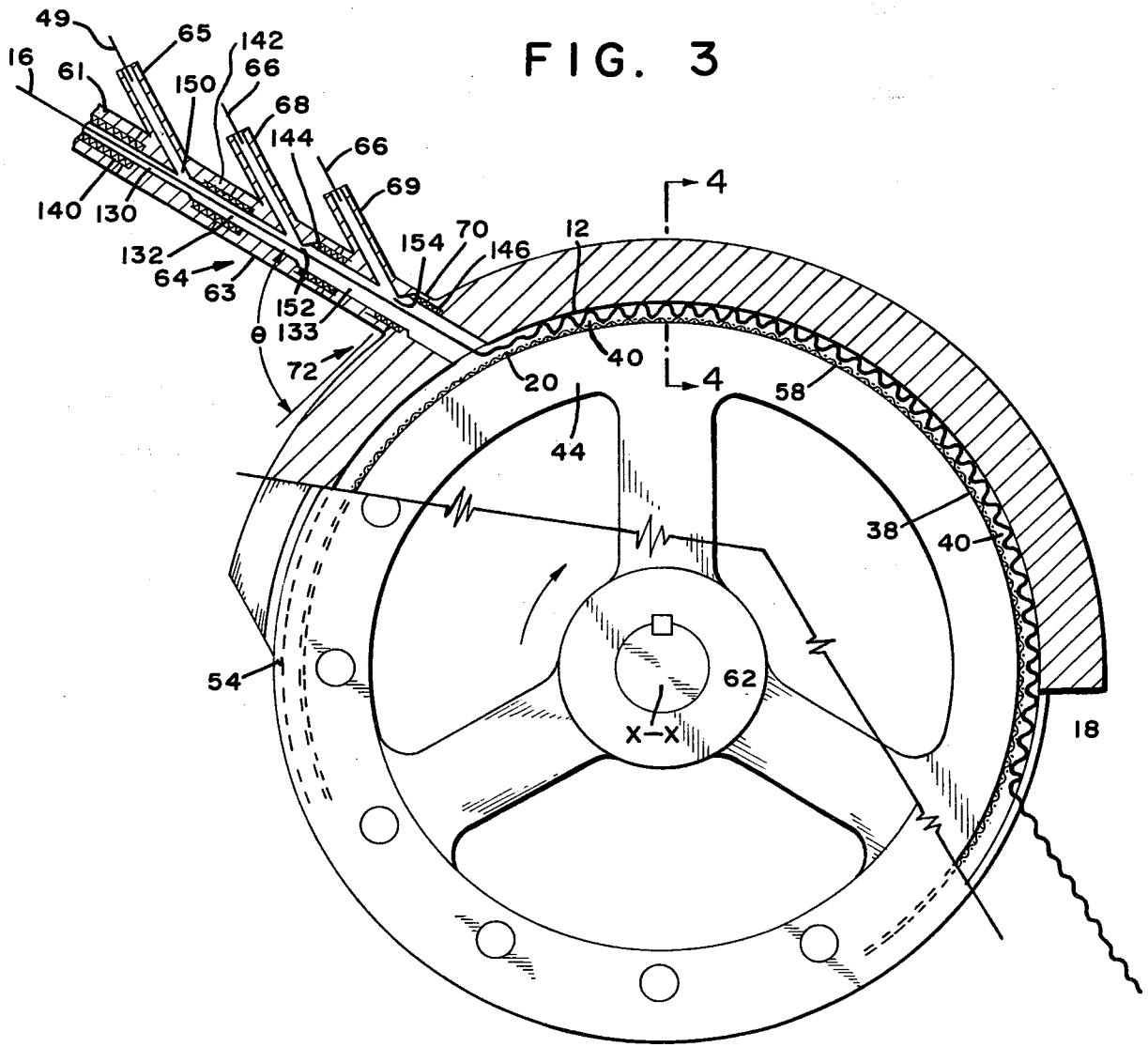
FIG. 3 is a view in elevation of another form of apparatus for crimping continuous filaments, the chamber and heating means being broken away to show the construction thereof.

As shown in FIGS. 3 and 4, barrier means 20 can be a screen 58 forming a wall of recess 42 in drum 44 opposite wall 60 of cover 34. The drum 44 is mounted on shaft 62 which rotates on bearings (not shown) about axis x—x. Filaments 16 enter tubes 61, 63 of a heating means (shown generally at 64). A first stream of heated fluid 49 enters conduit 130 of tube 61 through fluid inlet 65 forcing filaments 16 along the tube 61. At least a second stream of heated fluid 66 enters conduits 132, 133 through fluid inlets 68, 69 contacting filaments 16 and increasing the temperature thereof. Conduit 132 has a cross-sectional area larger than that of conduit 130. The cross-sectional area of conduit 133 is, in turn, larger than that of conduit 132. Increasing the cross-sectional areas of successive conduits prevents fluid backflow and facilitates passage of filaments 16 through the tubes at higher processing speeds, such as those having yarn velocities of about 200 to 30,000 feet per minute. Generally, the cross-sectional area of conduit 130 ranges from about 0.0004 to 0.0625 square inch; the cross-sectional area of conduit 132 ranges from about 0.0009 to 0.123 square inch; and the cross-sectional area of conduit 133 ranges from about 0.0016 to 0.200 square inch. Preferably, the cross-sectional area of conduit 130 is about 0.0006 to 0.040 square inch; the cross-sectional area of conduit 132 is about 0.001 to 0.090 square inch; and the cross-sectional area of conduit 133 is about 0.002 to 0.160 square inch. As shown in FIG. 3, each of the tubes can be provided with adjustment means 140, 142, 144, 146 such as screw threads or the like, for varying the distance between the ends 150, 152, 154 of fluid inlets 65, 68, 69 and chambers 130, 132, 133 communicating therewith, respectively. The adjustment means permit the variations in conduit cross-sectional area to be controlled closely with the velocity of yarn and fluid in the tubes.

The combined streams of fluid 49, 66 and filaments 16 enter tube 70 of fluid directing means, shown generally at 72. The latter directs the filaments 16 into contact with barrier means 20 disposed in chamber 12 in the manner set forth in connection with FIGS. 1 and 2. Fluid 49, 66 is separated from filaments 16 and expelled from chamber 12 through discharge ports (not shown) connected with passageway 59 of drum 44, as well as through passageway 74 formed between drum 44 and cover 34. A major portion of the fluid 49, 66 can, optionally be expelled from tube 62 of heating means 64 prior to entering tube 70 of fluid directing means 72, and from chamber 12 through screen 58. The filaments 16 emerge from chamber 12 through an outlet opening 18 in the manner set forth above in connection with FIGS. 1 and 2.

Figure 7:
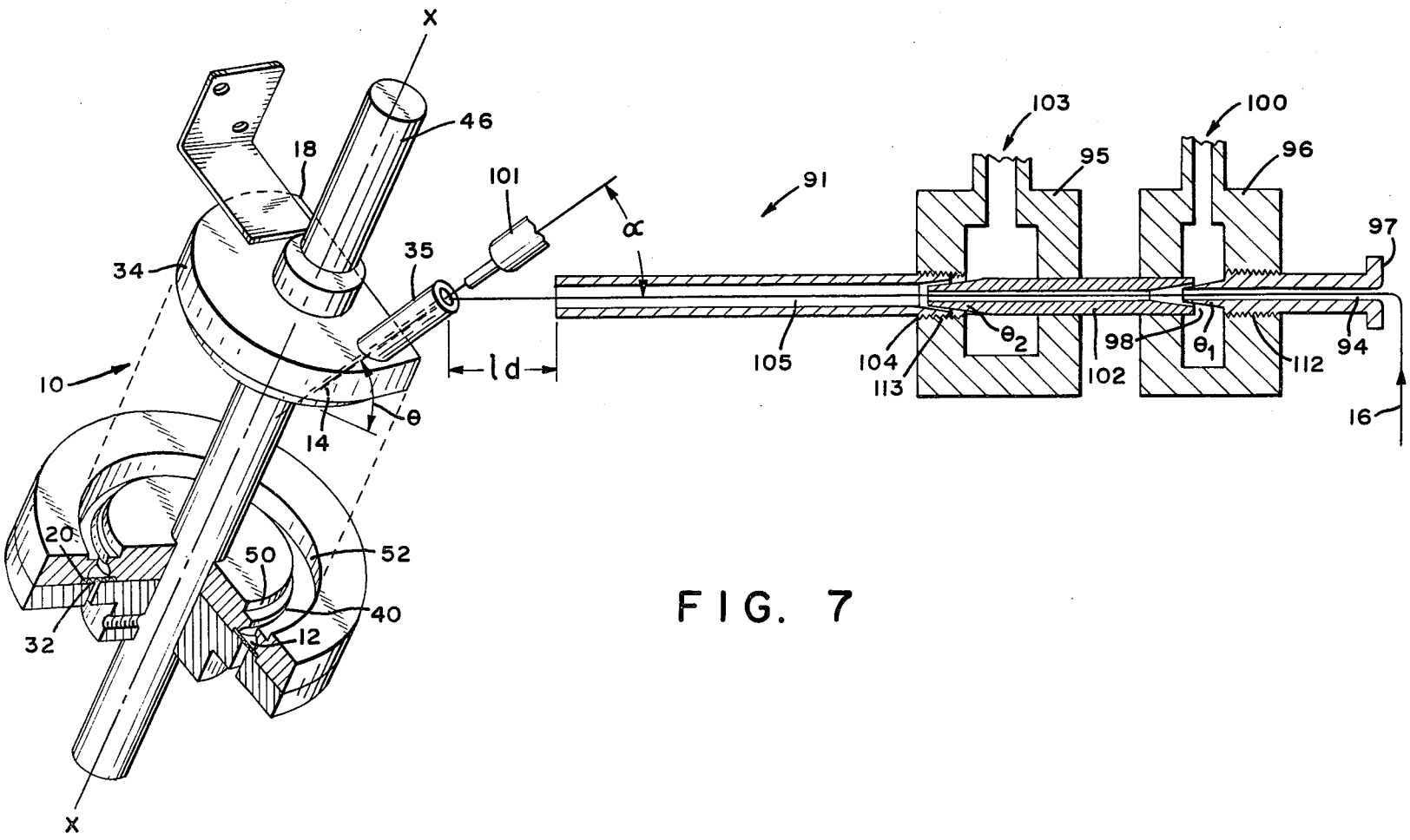
FIG. 7 is a perspective view of another embodiment of the invention, the heating means being sectioned to show the construction thereof.

In FIG. 7, the apparatus, shown generally at 91, has a plurality of fluid conduits, 94, 102 and 105 provided with progressively increasing cross-sectional areas and associated with adjustable fluid orifice openings 98 and 104. Filaments 16 are aspirated by the fluid 100, 103 past yarn guide 97 and into conduit 94. The filaments 16 are then directed into tube 35 through conduits 101', 105 by heated fluid from nozzle 101. Compressible fluid 100 enters conduit 96 through orifice opening 98 tapered at an angle $\theta_1$, with respect to the axis of the conduit 94.

The opening or closing of the orifice 98 can be adjusted by turning the yarn guide 97 either clockwise or counterclockwise. The amount of steam flow is controlled by the degree of opening of the orifice 98 which, in turn, regulates the tension exerted by the fluid on the moving filaments 16, and the temperature rise of the filaments due to the steam flow. Both the fluid and the filaments move downstream along the conduit 102. At the end of the conduit 101, the temperature of the fluid drops rapidly as a result of the rapid expansion of the compressible fluid, and the heat transferred to the moving filaments. A second source of heating fluid 103 is introduced at end of conduit 102 to further heat the filaments to a desired temperature. The second stream enters the annular orifice 104 at a predetermined temperature and pressure. The fluid flows through orifice 104 into the conduit 105. Orifice 104 is tapered with respect to the fluid jet axis at an angle $\theta_2$ as shown.

The apparatus 91 shown in FIG. 7 has significant structural advantages. The filaments will move along the conduit 105 smoothly and remain taut all the time since the cross-sectional area of the conduit 105 is larger than the prior conduit 102. "Chocking" of the fluid or fluid back flow from filament entrance 97 is prevented. Filament aspiration and velocity through the conduit is increased.

The total length of the conduits determines the residence time of the filaments therein. In general, longer conduits will heat the filaments to the desired temperature more uniformly and at a lower fluid temperature than shorter conduits. The apparatus 91 can, of course, be modified in various ways wtihout departing from the scope of the invention. For example, three sources of fluids could be used in tandem. The conduit could be provided with a round, rectangular, or tapered cross-section. The sources of fluid, 100 and 103, can comprise heated air or steam. Orifice 104 can be annular or comprise a single hole drilled along the conduit 102. The walls of the conduits 94, 102 and 105 may have a narrow slit (not shown) along the axis of the conduit which facilitates filament string-up during starting operation. After string-up, the slit can be covered up by thin sheet metal, or the like, to reduce heat loss to the surroundings.

Generally, the cross-sectional areas of orifices 98 and 104 range from about 0.0001 in.$^2$ to 2 in.$^2$; the taper angles $\theta_1$ and $\theta_2$ range from about 3 to 87°; the length of each of conduits 102 and 105 ranges from about 1" to 20"; the area ratio of downstream conduit 105 to upstream conduit 102 ranges from about 0.5 to 5; the number of conduits ranges from 1 to 10; and the filaments residence time ranges from about 0.0003 to 6 seconds. The fluid streams 100 and 103 contact and aspirate the filament 16 at a fluid velocity of about 10 to 2,000 feet per second, a total pressure of about 20 psig. to 3,000 psig., and a temperature of about room temperature to 700° C. Preferably, the cross-sectional areas of the orifices vary from about 0.0004 in.$^2$ to 1.8 in.$^2$; the inclining angles range from about 5 to 35°; the length of each of conduits 102 and 105 ranges from 2" to 12"; the number of conduits ranges from 2 to 8; the area ratio of downstream conduit 105 to upstream conduit 102 ranges from 1.1 to 3; and the filament residence time from 0.0008 seconds to 5 seconds. The fluid streams 100 and 103 contact the filaments 16 at a velocity of about 100 to 1,800 feet per second, a total pressure of about 40 psig. to 2,000 psig. and a temperature of about 100° C. to 500° C.

As shown in FIG. 5, the apparatus 10 can be provided with a crimp setting means, shown generally at 76, including fluid jet heating means 80, disposed in chamber 12 downstream of fluid directing means 37, for contacting the mass 38 of filaments 16 with a stream of heated fluid from heating vessel 78 to set the crimps therein. More specifically, the crimp setting means can comprise a fluid jet heating means 80, including at least one passageway 82, and preferably several passageway, disposed in cover 34 for communication with chamber 12 downstream of inlet opening 14. Heat of fluid entering vessel 78 travels through passageway 82 into chamber 12 in the form of a stream. The passageway is positioned in cover 34 so that the stream of heated fluid enters the compaction zone contacting the mass 38 of filaments 16 and setting the crimps therein. The temperature, volume, velocity and pressure of the stream of fluid from vessel 78 can vary depending on the denier of the filaments, the cross-sectional area of chamber 12, the rotational velocity of drum 44 and the angle at which the stream intersects the mass 38 of filaments 16. For relatively high speed yarn production, the cross-sectional area of the end 48 of the passageway 82 of the fluid jet heating means 80 should be about 0.0001 to 0.04 square inch, and preferably about 0.0006 to 0.03 square inch. Generally, upon contact with the mass 38 of filaments 16, the stream of fluid has a velocity of about 500 to 1500 feet per second and a temperature of about 150° to 350° C. and a total pressure of about 5 to 500 psig.; filaments 16 have a velocity of about 200 to 30,000 feet per minute, a temperature of about 100° to 220° C., a denier of about 1 to 25 per filament, and a yarn denier of about 15 to 5,000; the cross-sectional area of chamber 12 is about 0.00015 to 1.00 square inch. Preferably, the second stream of fluid contacts the mass 38 of filaments 16 at a velocity of about 600 to 1500 feet per second, a total pressure of about 10 to 300 psig. and a temperature of about 170° to 330° C., setting the crimps in filaments having a denier of about 2 to 15 per filament and a yarn denier of about 21 to 2,600. The angle of impact, $\theta$, is preferably about 30° to 70°, and the cross-sectional area of chamber 12 is about 0.00075 to 0.40 square inch.

In operation, yarn in the form of continuous filaments 16 is fed by aspiration into a stream of fluid 49 in a conduit 130. The filaments are thereafter contacted with at least a second stream 66 of fluid in a second conduit 132 of increased cross-sectional area to increase the temperature thereof in a uniform manner. Fluid directing means 70 directs the stream of fluid 49, 66 containing filaments 16 into contact with barrier means 20, disposed within chamber 12, to initiate crimping of the filaments 16. Fluid escape means 32 separates the major portion of the fluid from the filaments 16 and expels it from chamber 12. A carrier means transports the filaments 16 through chamber 12 to cause overfeeding of the filaments 16 into the chamber. The filaments 16 are subsequently forced against a mass thereof within a zone of compaction 40, emerge from the chamber 12 in crimped form, and are wound onto packages.

Figure 6:
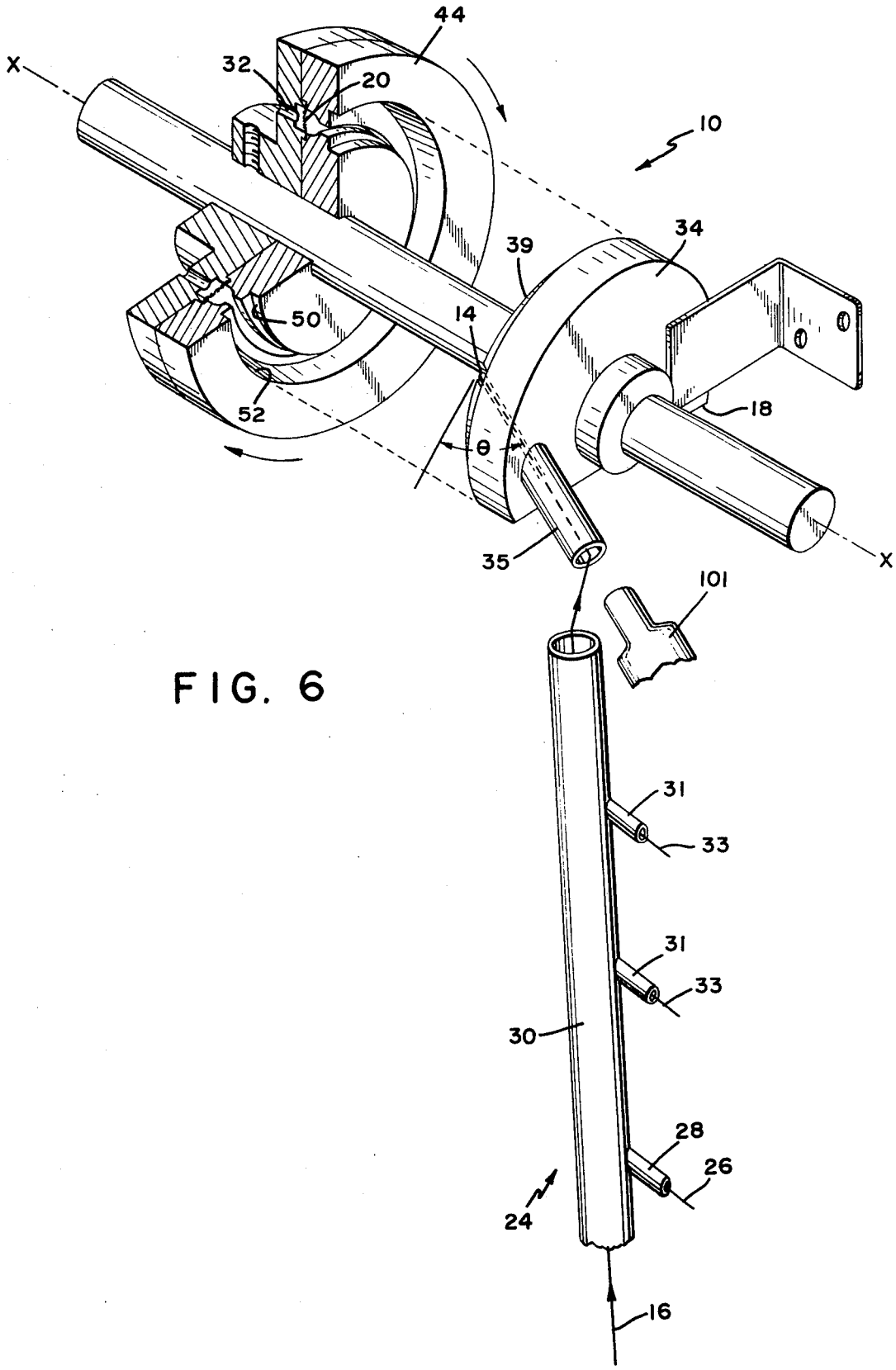
FIG. 6 is a perspective view illustrating still another embodiment of the apparatus of FIG. 1.

As shown in FIG. 6, tube 30 can be angularly positioned relative to tube 35 to facilitate separation of fluid from the filaments 16, the latter being directed into tube 35 by heated fluid from nozzle 101. The heating means can, alternatively additionally, comprise a stationary heating block(s), a rotating heating roll(s), or the like, heated electrically or by high temperature fluids, or one or more infrared, induction or microwave heaters, or a combination thereof. These and other modifications are intended to fall within the scope of the invention as defined by the subjoined claims.

While the method and apparatus of this invention have been described herein primarily in terms of texturizing thermoplastic filaments, especially polyester filaments, it is clear that the method and apparatus of the present invention can also be used to crimp a wide variety of other filaments, such as filaments composed of homopolymers and copolymers of the following materials: $\epsilon$-aminocaproic acid, hexamethylene adipamide, ethylene terephthalate, tetramethylene terephthalate, 1,4-cyclohexylenedimethylene terephthalate and blends thereof. In addition, the filaments 16 can be composed of polyacrylonitrile, polypropylene, poly-4-aminobutyric acid, cellulose acetate and blends thereof.

The following examples are presented in order to provide a more complete understanding of the invention. The specific techniques, conditions, materials and reported data set forth to illustrate the principles and practice of the invention are exemplary and should not be construed as limiting the scope of the invention.

EXAMPLE 1 (comparison)

Polyethylene terephthalate chips having number average molecular weight of 25,000 were melt spun using a screw type extruder in which the barrel and dye temperatures were maintained at 270° C. and 280° C., respectively. The spinnerette used had 34 holes, each hole having a capillary diameter of 0.010 inch and a length of 0.010 inch. An air quenched system was used to solidify the filaments. The yarn was a 255 denier, 34 filament, zero twist, partially oriented yarn having a round cross-section. The yarn was coated with approximately 0.25% by weight of a textile finish agent and drawn using a draw ratio of 1.68. The drawing process consisted of passing 10 wraps of the yarn around (1) a pair of heated rolls maintained at a temperature of 75° C., (2) a stationary block heater 6 inches long having a temperature of 180° C., and (3) a pair of draw rolls having a temperature of 175° C. The final draw denier was 150. Drawing speed was 2000 feet per minute.

The yarn was textured using the apparatus shown in FIG. 7. Yarn guide 97 had a diameter of 0.058 inches and a length of 0.3 inches at the point that filaments 16 passed through. The annular orifice 98, 0.001 square inch cross-sectional area, drew superheated steam from fluid reservoir 100 at a temperature of 340° C. and a pressure of 130 psig. The fluid conduit 102 had a diameter of 0.060 inches and a length of 8 inches. At the end of the conduit 102, superheated steam at a temperature of 340° C. and pressure of 150 psig was supplied from steam source 103 through a second annular orifice 104 having a cross-sectional area of 0.00055 in.$^2$. Both the first annular orifice, 98, and the second, 104, had a taper angle of 15°. Each of conduits 102 and 105 had a diameter of 0.075 inches and a length of 8 inches.

The opening and closing of the orifice, 98, was controlled simply by turning the guide 97 either clockwise or counterclockwise with respect to the conduit 102 to achieve an optimum steam flow rate. The guide 97 had 28 threads, 112, per inch. Similarly, the annular orifice 104 was adjusted by turning the second conduit 105 with respect to the first conduit 101'. Conduit 105 had 28 threads, 113, per inch. Initially, as the yarn 16 was fed through guide hole 97 and the yarn speed approached 5,700 feet per minute, a yarn slack at guide 97 was observed. At 5,700 FPM, the fluid jet 91 failed to aspirate the yarn completely.

EXAMPLE 2

The texturing process was carried out identical to the process described in Example 1 except that the diameter of the second conduit 105 was increased from 0.075 inches to 0.085 inches. Yarn was aspirated successfully at a speed of 8,900 FPM and remained taut within the fluid jet 91. The expired steam was vented into ambient and the angle $\alpha$ between the axis of conduit 105 and the axis of tube 35 was 45°. The distance, $l_o$, between the end of conduit 105 and tube 35 was 0.5 inches. Upon emerging from conduit 105, filaments 16 bent about $\alpha=45°$, and were aspirated by the main nozzle 101 into the main energy tube 35 at a speed of about 8,900 FPM. The main nozzle 101 had a fluid temperature of 235° C., a fluid pressure of 175 psig., a diameter of 0.050 inches and a cross-sectional area of 0.00196 square inches. The main energy tube 35 had a diameter of 0.100 inches and a length of 5 inches. The average yarn impact angle on the barrier means 20 was 60°. The yarn temperature was estimated to be about 160° C. at the moment of impact with barrier means 20. The barrier means 20 was a 90 mesh screen. The width of chamber 12 was 0.200 inches and the chamber height was 0.040 inches. The packing density of the textured plug was 34.4% and the residence time of the plug in chamber 12 was 4.2 seconds. The yarn was then removed from chamber 12 and wound on a conventional winder (not shown) at a speed of about 7,000 FPM. The yarn produced had a denier of 177 and was characterized as having a three dimensional, random oriented crimped configuration. There was no fusion among filaments of the yarn. The developed skein had a denier of 177 and about 45 crimps per inch and a skein shrinkage level of 42%, indicating that the yarn was suited for use in manufacture of wearing apparel.

Having thus described the invention in rather full detail, it will be understood that these details need not be strictly adhered to but that various changes and modifications may suggest themselves to one skilled in the art. It is accordingly intended that all matter contained in the above description and shown in the accompanying drawings shall be interpreted as illustrative and not in a limiting sense.

What is claimed is:

1. Apparatus for crimping continuous filaments comprising:

(a) a chamber having an inlet opening for receiving the filaments and an outlet opening for withdrawing the filaments;

(b) barrier means disposed in said chamber adjacent said inlet opening;

(c) fluid directing means for directing a stream of compressible fluid from a conduit containing said filaments into contact with said barrier means to initiate crimping thereof;

(d) fluid escape means associated with said chamber for separating the major portion of said fluid from said filaments and expelling it from said chamber;

(e) carrier means for transporting said filaments through said chamber, including a continuously moving surface associated with said chamber to cause overfeeding of said filaments into said chamber, said filaments being forced against a mass thereof within said chamber to produce crimps therein; and (f) heating means connected to and upstream of said fluid directing means and downstream of said conduit for contacting said filaments with heated fluid in a second conduit of increased cross-sectional area to increase the temperature of the filaments.

2. Apparatus as recited in claim 1, wherein said chamber has a curvilinear configuration.

3. Apparatus as recited in claim 1, wherein said barrier means has a coefficient of friction of about 0.05 to 0.9.

4. Apparatus as recited in claim 1, wherein said fluid escape means is a screen having a mesh size ranging from about 50 to 400.

5. Apparatus as recited in claim 1, wherein said heating means includes a tube having at least one fluid inlet therein.

6. Apparatus as recited in claim 5, wherein said tube has a length of about 3 to 60 inches.

7. Apparatus as recited in claim 6, wherein the number of fluid inlets is about 1 to 60.

8. Apparatus as recited in claim 1, wherein said fluid directing means comprises a tube having an end located in relatively close proximity to said barrier means, the cross-sectional area of said end being about 0.0002 to 0.30 square inch and the cross-sectional area of said chamber being about 0.00015 to 1.00 square inch.

9. Apparatus as recited in claim 1, wherein said fluid escape means is a plate containing a plurality of apertures, the number of apertures being sufficient to separate from said filaments and expel from said chamber about 60 to 98 percent of said fluid.

10. Apparatus as recited in claim 1, wherein the area ratio of said second conduit to said conduit ranges from about 0.5 to 5.

11. Apparatus as recited in claim 1, including adjustment means for varying the distance between adjacent ends of said conduits.

12. Apparatus as recited in claim 1, wherein said barrier means is a stationary, non-continuous impacting surface.

13. A method of crimping continuous filaments, comprising the steps of:

(a) feeding said filaments by aspiration into a stream of heated fluid in a conduit;

(b) contacting said filaments with at least a second stream of heated fluid in a second conduit of increased cross-sectional area to increase the temperature of the filaments;

(c) directing said stream containing said filaments into contact with barrier means disposed within a chamber, the contact having sufficient force to initiate crimping of said filaments;

(d) separating a major portion of said first and second streams of heated fluid from said filaments and expelling it from said chamber;

(e) transporting said filaments through said chamber by continuous movement of a surface therein at sufficient velocity to cause overfeeding of said filaments into said chamber, said filaments being forced against a mass thereof within said chamber to produce crimps therein; and (f) removing said filaments in crimped form from said chamber.

14. A method as recited in claim 13, wherein said filament contact said barrier means at an angle of impact of about 15° to about 75°.

15. A method as recited in claim 13, wherein said filaments contact said barrier means at a velocity of about 200 to 30,000 feet per minute.

16. A method as recited in claim 13, wherein said fluid is compressible.

17. A method as recited in claim 13, wherein the number of streams of fluid is about 1 to 60.

18. A method as recited in claim 13, wherein each of said fluid streams has a temperature of about 150° to 350° C.

19. A method as recited in claim 13, wherein said filaments are composed of polyester.

20. A method as recited in claim 19, wherein said filaments contain in excess of 40 crimps per inch when removed from said chamber.

21. A method as recited in claim 13, wherein said filaments are composed of material selected from the group consisting of poly 1,4-cyclohexylenedimethylene terephthalate, polyethylene terephthalate, polyhexamethylene adipamide, poly ϵ-aminocaproic acid, polypropylene, cellulose acetate, cellulose triacetate and blends thereof.

22. A method as recited in claim 13, including the step of separating a major portion of said fluid from said filaments upon contact of said stream containing said filaments with said barrier means.

* * * * *

UNITED STATES PATENT AND TRADEMARK OFFICE

CERTIFICATE OF CORRECTION

PATENT NO. : 4,135,280

DATED : January 23, 1979

INVENTOR(S) : Hsin L. Li, Hendrikus J. Oswald and Alfred L. Liland

It is certified that error appears in the above-identified patent and that said Letters Patent are hereby corrected as shown below:

Col. 6, line 45, "101" should be --102--.

Col. 6, line 57, "101" should be --102--.

Col. 7, line 57, "several passageway," should be --several passageways,--.

Col. 8, line 45, "alternatively" should be deleted.

Col. 12, line 8, "filament" should be --filaments--.

Signed and Sealed this

First Day of May 1979

[SEAL]

*Attest:*

RUTH C. MASON
*Attesting Officer*

DONALD W. BANNER
*Commissioner of Patents and Trademarks*